United States Patent [19]

Dehne

[11] Patent Number: 4,974,520

[45] Date of Patent: Dec. 4, 1990

[54] CONVEYOR WITH SELF-LOADING AND UNLOADING CARRIERS

[75] Inventor: Clarence A. Dehne, Farmington Hills, Mich.

[73] Assignee: Jervis B. Webb Company, Farmington Hills, Mich.

[21] Appl. No.: 341,586

[22] Filed: Apr. 21, 1989

[51] Int. Cl.[5] ..... B61B 3/00

[52] U.S. Cl. ..... 105/148; 104/93; 104/122; 414/911

[58] Field of Search ..... 105/148, 150, 152; 104/89, 288, 122, 284, 106; 414/911, 751, 626, 459, 460; 294/67.3, 67.1, 113, 907; 198/680; 901/47, 46, 23, 19; 212/205, 220, 221

[56] References Cited

U.S. PATENT DOCUMENTS

| | | | |
|---|---|---|---|
| 1,155,760 | 10/1915 | Sauvola | 104/122 |
| 2,924,484 | 2/1960 | Tolsma | 294/113 |
| 3,180,279 | 4/1965 | Thibault | 104/89 |
| 3,237,980 | 3/1966 | Helms | 294/113 |
| 4,341,161 | 7/1982 | Morita et al. | 104/89 |
| 4,462,315 | 7/1984 | Wakabayashi | 104/89 |
| 4,464,998 | 8/1984 | Wakabayashi | 104/89 |
| 4,475,462 | 10/1984 | Tsumaki et al. | 104/89 |
| 4,750,132 | 6/1988 | Pessina et al. | 414/751 |
| 4,770,106 | 9/1988 | Rose | 104/89 |
| 4,863,335 | 9/1989 | Herigstad | 414/495 |

FOREIGN PATENT DOCUMENTS

| | | | |
|---|---|---|---|
| 0518644 | 1/1931 | Fed. Rep. of Germany | 104/89 |
| 0520463 | 2/1931 | Fed. Rep. of Germany | 104/89 |
| 2756600 | 7/1979 | Fed. Rep. of Germany | 104/122 |
| 3432284 | 3/1986 | Fed. Rep. of Germany | 104/89 |
| 3710436 | 10/1988 | Fed. Rep. of Germany | 104/122 |
| 0120178 | 9/1979 | Japan | 104/89 |
| 0027979 | 2/1984 | Japan | 105/148 |
| 501911 | 2/1976 | U.S.S.R. | 104/122 |
| 18206 | of 1908 | United Kingdom | 104/122 |

*Primary Examiner*—Robert P. Olszewski
*Assistant Examiner*—Mark T. Le
*Attorney, Agent, or Firm*—Joseph W. Farley

[57] ABSTRACT

A conveyor having an electrified carrier track supporting wheeled, self-propelled carriers, in which each carrier is provided with power-driven, vertically movable load carrying structure operable to pickup a load from or deposit a load on a supporting surface located beneath the carrier track. Each carrier has load position sensors and a programmable controller that enable the pickup and depositing operations to be performed automatically for loads, such as newsprint rolls, of different dimension.

14 Claims, 3 Drawing Sheets

CONVEYOR WITH SELF-LOADING AND UNLOADING CARRIERS

SUMMARY OF THE INVENTION

This invention relates to improvements in a conveyor of the type having a carrier track supporting wheeled load carriers, each including depending load carrying structure and a carrier drive motor energizable from a conductor bar assembly associated with the carrier track.

In accordance with the invention, the load carrying structure of the carrier is power driven for movement between raised and lowered positions; and, control means provided on each carrier enables the carrier and its power driven load carrying structure to automatically pickup a load from or deposit a load on a support located beneath the carrier track.

More specifically, the load carrier of the invention includes a plurality of wheeled trolleys mounted on the carrier track and comprises a main frame supported from the trolleys in vertically spaced relation below the carrier track. Positioned vertically below the main frame is a subframe to which load carrying means is secured and depends downwardly for engagement with a load to be transported by the carrier. Power driven suspension means carried by the main frame suspends the subframe therefrom for vertical movement of load carrying means between raised and lowered positions, the load being supported by the load carrying means in the raised position and being transferable in the lowered position between the load carrying means and a supporting surface disposed below the carrier track.

The control means provided on the carrier regulates the operation of the carrier driving motor and the power driven suspension means. This control means includes load position sensing means responsive to the presence of a load on the supporting surface for positioning the carrier along the carrier track at a desired location for either picking that load up, or for depositing at a desired spacing from that load another load from the carrier.

For a load pickup operation the load position sensing means comprises a pair of load sensors spaced longitudinally of the carrier and adapted to detect the opposite longitudinally spaced ends of a load on the supporting surface so as to position the carrier with its load carrying means centered longitudinally of the load. A plurality of such pairs of load sensors may be provided, each pair being spaced apart longitudinally a different distance which corresponds to the length of one of a corresponding plurality of different sized loads.

For an operation in which a load being transported is to be deposited on the supporting surface at a desired spacing from a load previously deposited thereon, the load position sensing means includes a load detector which is responsive to the presence of such a previously deposited load and which is spaced longitudinally from a pair of the load sensors a distance corresponding to the desired spacing between deposited loads. Such a load detector is employed with each pair of a plurality of pairs of load sensors.

Preferably, the control means includes a carrier mounted programmable controller having an input section, which receives signals from the load sensors and detectors, and having an output section which supplies control signals to the carrier drive motor and to the power driven suspension means.

In the embodiment of the invention disclosed herein, the loads to be handled are cylindrical objects such as newsprint rolls and the load carrying means comprises a pair of load carrying arms secured to the carrier subframe in transversely spaced relation. These load carrying arms extend downwardly from the subframe and have mutually converging free ends adapted to straddle the opposite sides of a newsprint roll and form a cradle engageable therewith. The power driven suspension means comprises a reversible motor mounted on the carrier main frame, a drive shaft driven by the motor and extending longitudinally of the main frame, and a pair of motion transmitting assemblies, such as jack shafts, coupled to the drive shaft and to the carrier subframe. When the motor has been energized to place the load carrying arms in their lowered position, the carrier can be driven along the carrier track so as to move the free ends of the load carrying arms into or out of engageable relation with the opposite sides of a cylindrical newsprint roll located on the supporting surface in axial or end wise vertical alignment with the carrier track. The newsprint roll can thus be automatically picked up or deposited by a carrier of the invention having the control means previously described.

The foregoing and other features and advantages of the invention will be further described in connection with the embodiments shown in the accompanying drawings.

DETAILED DESCRIPTION

Figure 2:
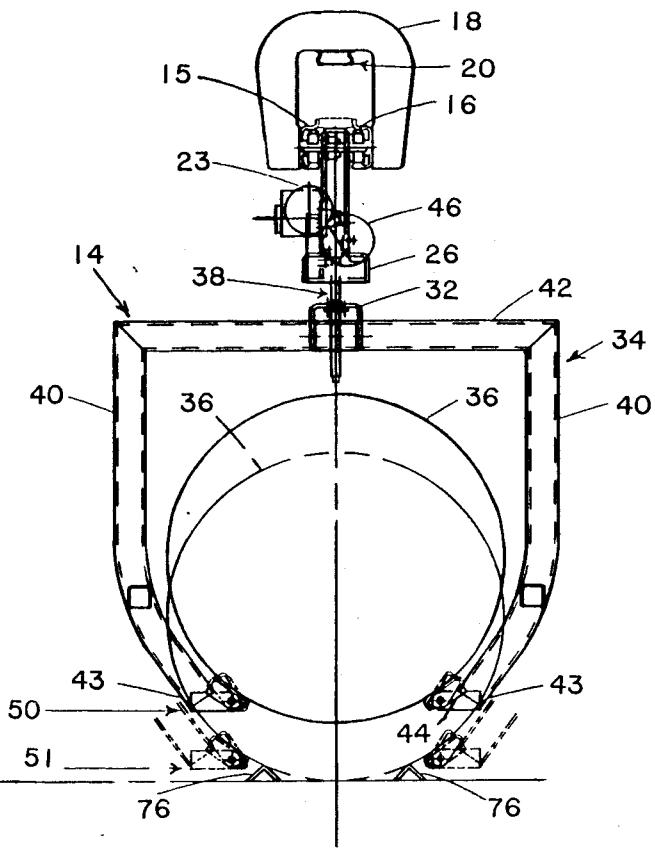
FIG. 2 is an end elevation of the conveyor and carrier of FIG. 1.
Figure 1:
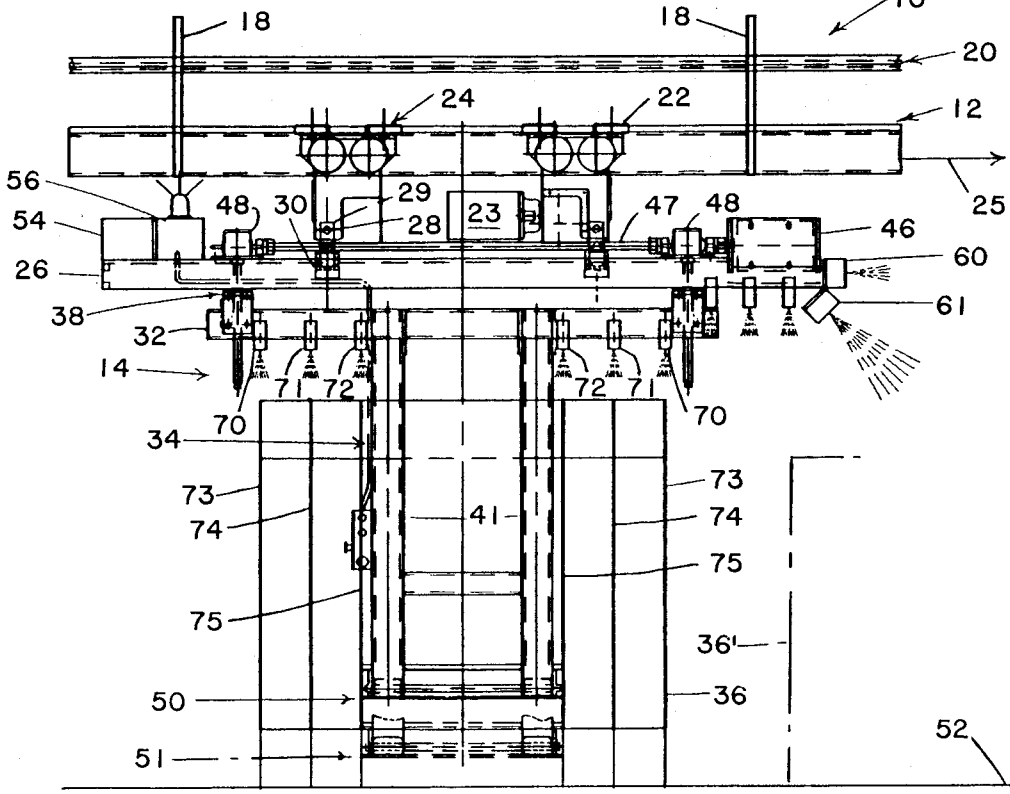
FIG. 1 is a side elevation showing a portion of a conveyor of the invention including a load carrier for handling newsprint rolls of different sizes.

The portion of a conveyor 10 of the invention shown in FIGS. 1 and 2 comprises a carrier track 12 and a load carrier 14. The carrier track 12, which may be of any desired length and layout (including switch-connected branch tracks), is composed of a pair of channel section track members 15 and 16 supported in toe-to-toe relation by longitudinally spaced track yokes 18 in a conventional manner. An electrical conductor bar assembly 20 extends along the track 12, and is supported above the track members 15 and 16 by the track yokes 18, as best shown in FIG. 2.

The load carrier 14 includes wheeled trolleys 22 and 24 mounted on the carrier track members 15 and 16, the trolley 22 having driving means 23 powered from the conductor bar assembly 20 for propelling the load carrier along the track, the normal direction of forward carrier movement being indicated by the arrow 25 in FIG. 1. Carrier structure described below is supported by the trolleys 22 and 24.

This carrier structure comprises a main frame 26 extending longitudinally of the track 12 and connected to the trolleys in vertically spaced relation below the track by supporting means 28 providing a horizontal pivoted connection 29 to each of the trolleys and vertical pivotal connections 30 to the main frame 26. A carrier subframe 32, positioned vertically below the main frame 26 and having load carrying means 34 secured thereto and depending therefrom for engagement with a load 36 to be transported by the carrier 14, is suspended from the main frame by power driven suspension means 38.

In the carrier structure illustrated, the load carrying means 34 is particularly adapted for the transporting of cylindrically shaped loads 36 such as newsprint rolls which may differ in axial length. This load carrying means 34 is formed by a pair of load carrying arms 40, each consisting of two interconnected, longitudinally spaced members 41 secured in transversely spaced relation to transverse subframe members 42. The arms 40 extend downwardly from the subframe members 42 and have converging free ends 43 adapted to straddle the opposite sides of a load, each free end 43 being provided with a pivoted load engaging pad 44.

The power driven subframe suspension means 38 comprises a reversible motor 46 mounted on the main frame 26, a longitudinally extending drive shaft 47 driven by the motor 46, and a pair of longitudinally spaced motion transmitting assemblies 48, such as jack shafts, coupled to the drive shaft 47 and to the subframe 32. Energization of the motor operates the assemblies 48 to move the load carrying arms 40 vertically between the raised, load supporting position 50 shown in full line in FIGS. 1 and 2 and the lowered position 51 shown in broken line. In this lowered position, a load 36 is transferable between the load carrying arms 40 and a supporting surface 52 disposed below the carrier track 12 to either deposit the load 36 on the supporting surface 52 or to pickup a load 36 thereon.

Figure 3:
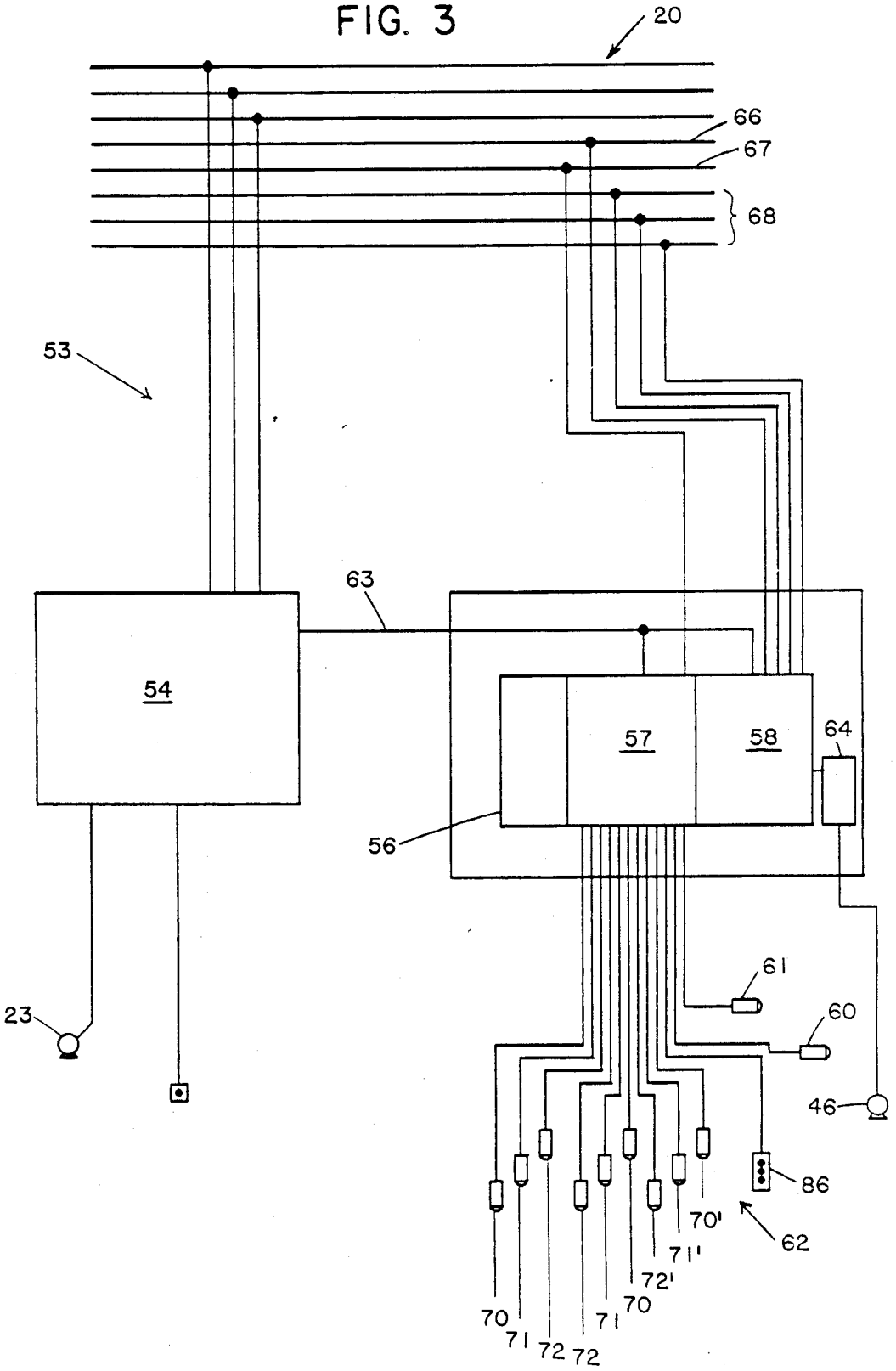
FIG. 3 is a schematic diagram illustrating the relation between the operational and control components of a carrier of the conveyor of FIGS. 1 and 2.

Control means 53 mounted on the load carrier 14 and schematically illustrated in FIG. 3, automatically regulates the operation of the carrier driving motor 23, and the suspension drive motor 46 for both load pickup and load depositing operations of the load carrier 14. The principal components of the control means are a variable frequency motor controller 54 connected to the carrier driving motor 23 and powered from the conductor bar assembly 20, and a programmable logic controller 56 having an input section 57 and an output section 58. Connected to the input section 57 are various carrier-mounted sensing elements which include a first forwardly directed banking sensor 60 responsive to the presense of a preceding load carrier for preventing overtaking engagement of the load carrier 14 therewith; a safety sensor 61 for detecting the presence of other objects in the path of travel of the load carrier 14; and load position sensing means 62 responsive to the presence of a load 36 on the supporting surface 52 for positioning the load carrier 14 along the track 12 at a desired location for the transfer of a load 36 to or from the supporting surface 52. The output section 58 supplies control signals to the motor controller 54 through a connector 63 and to a starter 64 for the suspension drive motor 46. As shown in FIG. 3, the output section 58 is also arranged to exchange signals with a group of control bars of the conductor bar assembly for communication with a central controller for a conveyor system having a plurality of the load carriers 14 and a route network over which such carriers are dispatched. Since such communication features will vary from one conveyor system to another and are available in various forms known to persons skilled in the art, they will not be described in further detail. In general however, the communication features may include start and stop signals through a conductor bar 66, carrier position signals through a conductor bar 67, and carrier operation command and execution signals through a conductor bar group 68.

The load position sensing means 62 are also shown in FIG. 1 and comprise a first group of elements, which will be referred to as load pickup sensors, that are adapted to position the load carrier 14 in longitudinally centered relation with a load 36 to be picked up; and, a second group of elements, which will be referred to as load detectors, that are adapted to position the load carrier 14 in a desired relation to a previously deposited load 36' on the supporting surface in order to properly transfer a load from the load carrier thereto.

As illustrated, the load pickup sensors consist of three pairs of photocells 70, 71 and 72 arranged longitudinally of the carrier subframe 32 so that each pair of sensors is adapted to detect the opposite, longitudinally spaced ends of a load 36 of a certain length—specifically, the sensor pair 70 is spaced to detect the ends 73 of a full length newsprint roll, the sensor pair 71 the ends 74 of a $\frac{3}{4}$ length newsprint roll and the sensor pair 72 the ends 75 of a $\frac{1}{2}$length newsprint roll. A load detector is provided for each pair of sensors, namely a detector 70' for the sensor pair 70, a detector 71' for the sensor pair 71 and a detector 72' for the sensor pair 72, each of these detectors being spaced longitudinally and forwardly of its associated sensor pair a distance corresponding to the desired spacing between a previously deposited load 36' and a load to be transferred from the load carrier 14 to the supporting surface 52.

In a load pickup operation, the suspension drive motor 46 is energized to move the load carrying arms 40 to their lowered position 51, the object detector 61 is deactivated, the carrier drive motor 23 is started, and the carrier is advanced on a load 36 resting on the supporting surface 52 and held in endwise aligned relation with the carrier track 12 by suitable chocks or guides 76, as shown in FIG. 2. The pads 44 on the free ends of the load carrying arms 40 in their lowered position move under and into facing relation with the sides of the load 36. When the opposite ends of the load 36 are simultaneously sensed by one of the pairs of pickup sensors 70, 71 or 72, the carrier drive motor 23 is stopped. The controller 56 is programmed in response to these input conditions to energize the suspension drive motor 46 to move the load carrying arms 40 to the raised position 50 and activate the object detector 61. The carrier 14 is then operable by the carrier drive motor 23 to transport the load to any desired destination. Should that destination be one at which the transported load is to be deposited behind a previously deposited load 36' (for example, where loads are stored endwise in rows), the carrier 14 advances with the object sensor 61 inactive until the end of the load 36' is sensed by the detector 70', 71' or 72' associated with the pair of pickup sensors 70, 71 or 72 that have sensed the load being transported. The controller 56 responds to these input conditions by stopping the carrier drive motor 23 and energizing the suspension drive motor 46 to move the load carrying arms 40 to the lowered position 51, transferring the transported load 36 to the supporting surface 52 at a determined spaced relation to the load 36'. The carrier 14 is then moved forward with the load carrying arms 40 in the lowered position until any previously deposited loads have been cleared. In a conveyor system where loads are so stored in endwise relation, the pickup operation described above is performed on the load at the head end of a line of such loads, the carrier being advanced along the line with its load carrying arms 40 in their lowered position until no preceding load is detected.

Figure 4:
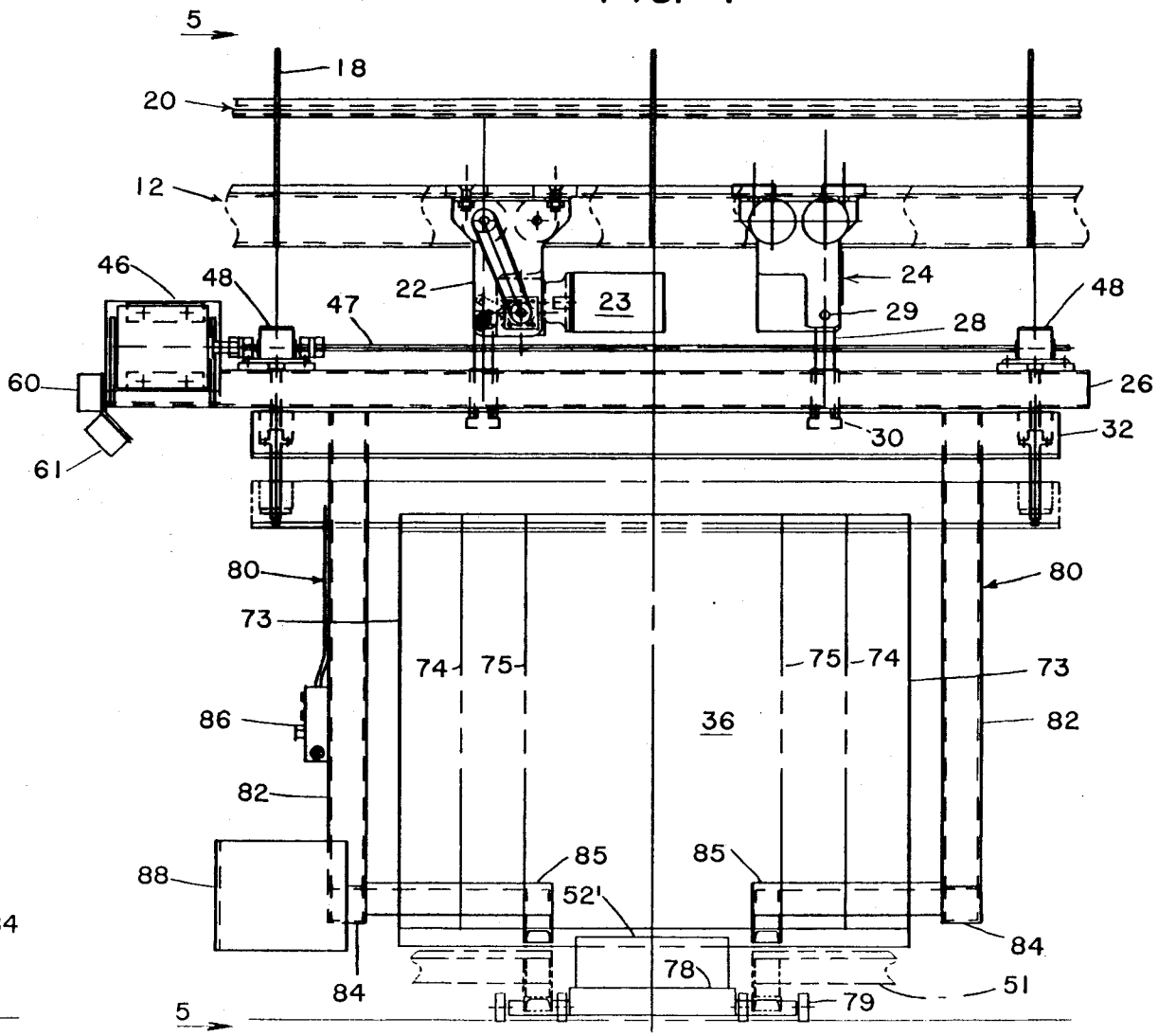
FIG. 4 is a side elevation similar to FIG. 1 showing an alternative form of the carrier of the invention and including a transversely movable shuttle cart for receiving a newsprint roll from the carrier.
Figure 5:
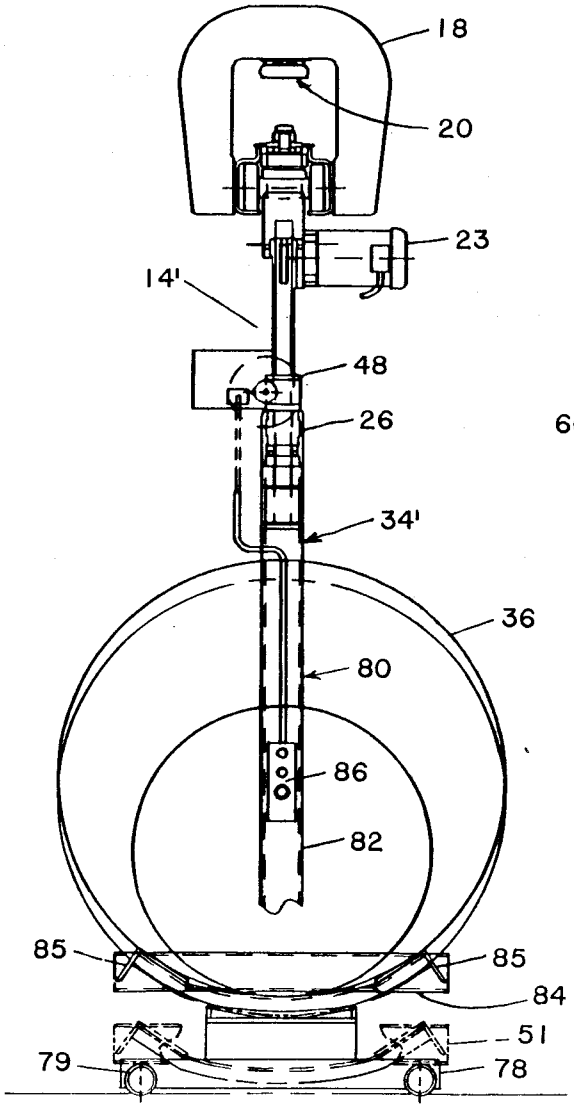
FIG. 5 is an end elevation of the structure shown in FIG. 4, taken as indicated by the arrows 5—5 thereon.

FIGS. 4 and 5 illustrate an alternative form of load carrier 14' which employs basically the same components as the carrier 14 (identified by the same reference numbers), but which is adapted to transfer a load 36 between load carrying means 34' of the carrier and a supporting surface 52' provided on a shuttle cart 78 mounted on wheels 79 for movement in a direction transverse to the conveyor track 12. The load carrying means 34' comprises a pair of load supports 80, each consisting of a support member 82 having one end secured to the carrier subframe 32 and extending vertically downwardly therefrom to a cradle formed by a transverse member 84 and a pair of parallel, longitudinally extending, transversely spaced load engaging members 85. The cradle member 85 of one of the pair of load supports 80, as shown in FIG. 4, project toward the cradle members 85 of the other load support 80 of the pair a distance such that full, three-quarters and one-half size newsprint rolls can be handled.

This alternative load carrier 14' may be provided with a manual push button control 86 for enabling the carrier to be properly positioned relative to the shuttle cart 78 for a load transfer operation, and may also be provided with a safety bumper 88 operable to stop the carrier driving motor 23 on contact with an object.

For a pickup operation, the carrier 14' is moved into a longitudinally centered relation with the path of transverse movement of the shuttle cart 78. With the carrier load supports 80 in their lowered position 51, the shuttle cart 78 is shifted into aligned position with the carrier and the suspension drive motor 46 is energized, moving the load supports 80 to their raised position 50. A load depositing operation is the reverse except that an empty shuttle cart 78 may be prepositioned in load receiving relation with the carrier 14'.

I claim:

1. A conveyor for transporting cylindrically shaped loads between locations disposed along a conveyor track, each such location being provided with load supporting means for positioning a cylindrically shaped load in axial alignment with said carrier track and at a defined vertically spaced distance below said carrier track, said conveyor including:

a load carrier having a plurality of trolleys mounted on said track;

a main frame supported by said trolleys below said track;

a subframe positioned below said main frame;

power driven suspension means operably associated with said main frame and subframe for moving said subframe vertically between raised and lowered positions;

load carrying means secured to and extending downwardly from said subframe toward said load supporting means, said load carrying means consisting of a pair of separate load carrying arms permanently fixed to said subframe in transversely spaced relation, the lowermost portions of said load carrying arms forming a pair of parallel and permanently fixed load engaging portions transversely spaced in centered relation with said track by a distance less than the diameter of said cylindrically shaped load, automatic control means on said conveyor for controlling movement of said carrier and positioning said subframe in said lowered position with said load engaging portions positioned to move into or out of a facing engageable relation with opposite sides of said axially aligned cylindrically shaped load on said supporting means, whereby said load engaging portions are operable in response to upward movement of said subframe between said positions to engage and pick up said load from said load supporting means and are operable in response to downward movement of said subframe to said lowered position to deposit said load on said supporting means and to clear said deposited load by movement of said load carrier along said track.

2. A conveyor according to claim 1 wherein an electrical conductor bar assembly is associated with said carrier track, carrier driving means powered from said conductor bar assembly is associated with at least one of said trolleys for propelling said carrier longitudinally along said carrier track, and means for energizing said power driven suspension means from said conductor bar assembly.

3. A conveyor according to claim 2 wherein said control means are mounted on said carrier and include load position sensing means responsive to the presence of said cylindrically shaped load on said load supporting means for positioning said carrier along said carrier track with said subframe in said lowered position at a desired location relative to said load.

4. A conveyor according to claim 3 wherein said load position sensing means comprises load pickup sensors arranged longitudinally of said carrier at a spacing such that said sensors are adapted to detect the opposite axially spaced ends of said cylindrically shaped load on said load supporting means for positioning said carrier with said load carrying means centered longitudinally of such load.

5. A conveyor according to claim 4 wherein said sensors are arranged in a plurality of pairs, each pair of sensors being spaced apart longitudinally a distance corresponding to the distance between the axially opposed ends of said cylindrically shaped load of a certain length.

6. A conveyor according to claim 5 wherein said load position sensing means includes detecting means responsive to the presence of a previously deposited cylindrically shaped load on said load supporting means for positioning said carrier at a desired location relative to such previously deposited load, said detecting means including a detector for each of said pairs of sensors, each detector being spaced longitudinally from its pair of sensors a distance corresponding to the spacing between such previously deposited load and a load to be deposited.

7. A conveyor according to claim 3 wherein said load position sensing means includes detecting means responsive to the presence of a previously deposited cylindrically shaped load on said load supporting means for positioning said carrier at a desired location relative to such previously deposited load.

8. A conveyor according to claim 3 wherein said control means further comprises carrier sensing means responsive to the presence of a preceding carrier for preventing said carrier from colliding with such preceding carrier.

9. A conveyor according to claim 2 wherein said control means are mounted on said carrier for independently operating said carrier driving means and said power driven suspension means.

10. A conveyor according to claim 1 wherein said power driven suspension means comprises a reversible motor mounted on said main frame, and a pair of longitudinally spaced motion transmitting assemblies coupled to said motor, said motion transmitting assemblies connecting said main frame to said subframe.

11. A conveyor according to claim 1 wherein said load supporting means comprises a supporting surface on which said cylindrically shaped loads are positionable.

12. A conveyor for transporting cylindrically shaped loads between locations disposed along a conveyor track, each such location being provided with load supporting means for positioning a cylindrically shaped load in axial alignment with said carrier track and at a defined vertically spaced distance below said carrier track, said conveyor including:

a load carrier having a plurality of trolleys mounted on said track;

a main frame supported by said trolleys below said track;

a subframe positioned below said main frame;

power driven suspension means operably associated with said main frame and subframe for moving said subframe vertically between raised and lowered positions;

load carrying means secured to and extending downwardly from said subframe toward said load supporting means, said load carrying means comprising a pair of load supporting members secured to said subframe in a longitudinally spaced relation exceeding the maximum axial length of said cylindrically shaped load, each load supporting member extending downwardly from said subframe and having a lower end, and load engaging portions comprising a pair of mutually facing cradles secured to the lower ends of said load supporting members, each cradle including a transverse member and a pair of fixed load engaging members projecting longitudinally therefrom, said load engaging members being transversely spaced in centered relation with said track by a distance less than the diameter of said cylindrically shaped load, control means on said conveyor for controlling movement and positioning said conveyor such that said cradles in said lowered position of said subframe are positionable, by relative movement between said load carrier and load supporting means, under and in facing relation with oppositely facing surfaces of said axially aligned cylindrically shaped load on said supporting means, whereby said cradles are operable in response to upward movement of said subframe between said positions to engage and pick up said load from said load supporting means and are operable to deposit said load on said load supporting means in response to downward movement of said subframe between said positions.

13. A conveyor according to claim 12 wherein said load supporting means is provided on a shuttle cart movable transversely to the carrier track between said pair of cradles.

14. A conveyor according to claim 1 wherein a load engaging pad is pivoted to the free end of each of said arms.

* * * * *